US005367846A

United States Patent [19]

vonRoenn, Jr.

[11] Patent Number: 5,367,846

[45] Date of Patent: Nov. 29, 1994

[54] INTERLOCKING GLASS BLOCK SYSTEM

[76] Inventor: Kenneth F. vonRoenn, Jr., 156 Crescent Ave., Louisville, Ky. 40206

[21] Appl. No.: 75,726

[22] Filed: Jun. 14, 1993

[51] Int. Cl.[5] ..... E04C 1/42

[52] U.S. Cl. ..... 52/308; 52/428; 52/580; 52/586.2

[58] Field of Search ..... 52/306, 307, 308, 426, 52/427, 428, 580, 603, 586.1, 586.2

[56] References Cited

U.S. PATENT DOCUMENTS

| | | | |
|---|---|---|---|
| 2,052,229 | 8/1936 | Hyde | 52/308 |
| 2,228,363 | 1/1941 | Pinney | 52/308 |
| 2,232,798 | 2/1941 | Paddock | 52/308 |
| 2,625,717 | 1/1953 | Wampler et al. | 52/308 |
| 3,401,496 | 9/1968 | Zöpnek | 52/308 |
| 4,635,420 | 1/1987 | Batky | 52/308 X |

FOREIGN PATENT DOCUMENTS

| | | | |
|---|---|---|---|
| 3-279543 | 12/1991 | Japan | 52/306 |

*Primary Examiner*—Carl D. Friedman
*Assistant Examiner*—Kevin D. Wilkens
*Attorney, Agent, or Firm*—Gipple & Hale

[57] ABSTRACT

A glass construction block comprising a plurality of glass members, each of which has a front wall, a rear wall and a plurality of side walls. A frame surrounds the glass members and is secured to the glass members spacing the glass members apart from each other while holding the glass members in a static position. The frame defines a channel member with side walls which extend inward from the outer side edge of the glass members terminating in a bottom wall and has flange portions which extend outward and are secured to the side walls. The blocks are assembled as a wall system by fitting a positive rib placed into the channel member into the channel member of an adjacent block. The two are adjoined with a void between the edges of the blocks which is then filled with a sealant.

23 Claims, 7 Drawing Sheets

INTERLOCKING GLASS BLOCK SYSTEM

BACKGROUND OF THE INVENTION

A. Field of the Invention

The invention generally relates to glass blocks used in construction of walls, partitions, and panels and the like and to methods used to constructing such walls, partitions, and panels. More particularly, the invention relates to an architectural glass block constructed with a frame which holds a plurality of cast glass pieces or numbers in a spaced static relationship forming a glass construction block which, when fitted together with other similarly constructed glass blocks, provides enhanced structural integrity and strength to the wall, partition or panel.

B. Description of Prior Art

Glass block construction is a favorite architectural construction material from a standpoint of having an aesthetically pleasing appearance, thermal and sound insulating ability. The ability of glass blocks to transmit light provides optimum illumination and low maintenance requirements.

Commonly used glass blocks are formed by fusing together two halves of pressed glass which result in an upstanding central projection or ridge around the middle of the circumference of the block. Walls and panels of such glass blocks are assembled by using on site mortar, cement, grout or caulking material in the same manner that regular bricks or cement blocks are constructed.

A problem with these non-porous glass blocks is that they do not form a strong bond with mortar and attempts have been made to overcome this problem by roughening the side walls of the glass blocks or applying a resinous coating to the same so that the mortar can better adhere to the surface of the block.

In laying glass blocks, a higher degree of skill and care is needed than with bricks or other types of masonry. Glass blocks are usually laid in straight, horizontal courses and vertical tiers rather than overlapping or offset courses as in the case of bricks and concrete blocks and it is important from a structural standpoint as well as an aesthetic standpoint that the blocks be uniformly spaced both horizontally and vertically. Also because glass blocks are significantly heavier than bricks or concrete blocks and since they do not absorb water from the mortar as do bricks and concrete blocks, the cement or mortar should be used in a firmer mix to support the weight of the blocks. In addition, since mortars which are suitable for the use in laying glass blocks are the type which set slowly, only a few courses of block can be laid at a time due to the weight of the blocks which tend to squeeze out the mortar between the lower courses.

For all of the aforementioned reasons, glass blocks despite their architectural advantage, are often avoided by builders because of the weight of the construction on non-load bearing areas, time involved in construction, lack of skilled construction personnel and relatively high labor cost in constructing such structures.

A number of efforts have been made throughout the years to facilitate the construction of glass block panels and walls and such efforts have been aimed at providing spacing, reinforcement and tying devices for the blocks. Examples of glass building blocks having specific interlocking construction which are cast in the block, such as a tongue and groove construction, are shown by U.S. Pat. Nos. 250,635; 298,418; and 302,289. A construction block with interlocking construction is shown by U.S. Pat. No. 4,258,522. The '522 construction block is additionally provided with projecting top course members and bottom recesses which interlock. U.S. Pat. Nos. 1,463,969 and 4,426,815 show the use of reinforcing rods to provide additional stability to the building blocks. Additional patents show the use of various frame or spacer members which provide the support or locking between the various glass blocks. U.S. Pat. No. 5,033,245 discloses a plastic block with molded continuous peripheral edge flanges including a tongue element adapted to seat in a groove formed on an opposing plastic block. U.S. Pat. No. 4,986,043 discloses a linear spacer member with fits around the periphery of the block with a dual center channel section adapted to fit around ribs formed in that block and in an adjacent glass block. U.S. Pat. No. 4,891,925 shows a hollow bodied block with exterior offset pins and circumferential flanges defining cavities which hold connecting members to connect the blocks into a unified wall structure. U.S. Pat. No. 4,959,937 discloses a number of connectors formed with a groove to fit over a ridge of the solid cast glass blocks, the connector being selectively provided with one or more projecting members which is inserted in the space between adjacent blocks. U.S. Pat. No. 4,628,652 provides connecting structures on the side of solid glass block with the sides of the block being alternative male and female members; or alternatively one side of the block containing male circular members and the opposing side defining female circular depressions allowing the sides of opposing blocks to be connected together. In this '652 reference, all courses must be aligned and blocks of the same size.

Accordingly, a need exists to facilitate the laying of glass blocks, which have less load bearing weight, are more economical and of better quality than were previously attainable.

These and other objects of the invention, as well as a fuller understanding, can be had by reference to the following description and claims.

SUMMARY OF THE INVENTION

A glass construction block is constructed with a plurality of angularly sided glass pieces or members held in a static relationship and spaced apart by a frame assembly. Each glass member is configured with a front wall and a back wall and a plurality of side walls. A frame assembly surrounds the side walls of the glass member and is secured to the periphery of the side walls of the glass member. The frame assembly defines a flanged channel member with side walls which extend inward from the side wall surfaces of the glass members along the back wall of each respective glass member and a bottom wall connected to said channel member side walls. Flange portions extend outward from said channel member side walls to the end of the glass member sides and are secured to the periphery of the glass members. A protruding rib member is secured in the channel member and projects outward past the panel side wall. The protruding rib member has an external configuration which allows it to fit into the internal configuration of the channel member of an adjacent block frame.

One object of the invention is to use a frame member to join separate cast glass members to form a glass block as well as join the glass blocks to each other.

Another object of the invention is to allow installation with offset glass block courses and for the installation of walls with different sized blocks such as a combination of squares and rectangles or other shapes such as triangles and hexagons.

Still another object of the invention is to provide a block in which the width, length and depth dimensions are completely variable.

Yet another object of the invention is to provide a block which can be installed in curves.

In the accompanying drawings, there is shown an illustrative embodiment of the invention from which these and other of objectives, novel features and advantages will be readily apparent.

DETAILED DESCRIPTION OF THE DRAWINGS

Figure 2:
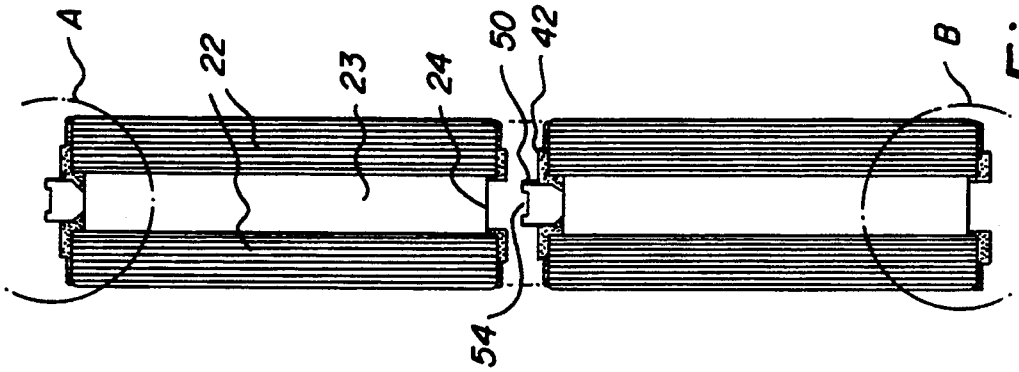
FIG. 2 is a cross sectional view of the block assembly in FIG. 1 taken along lines 2'—2'.
Figure 1:
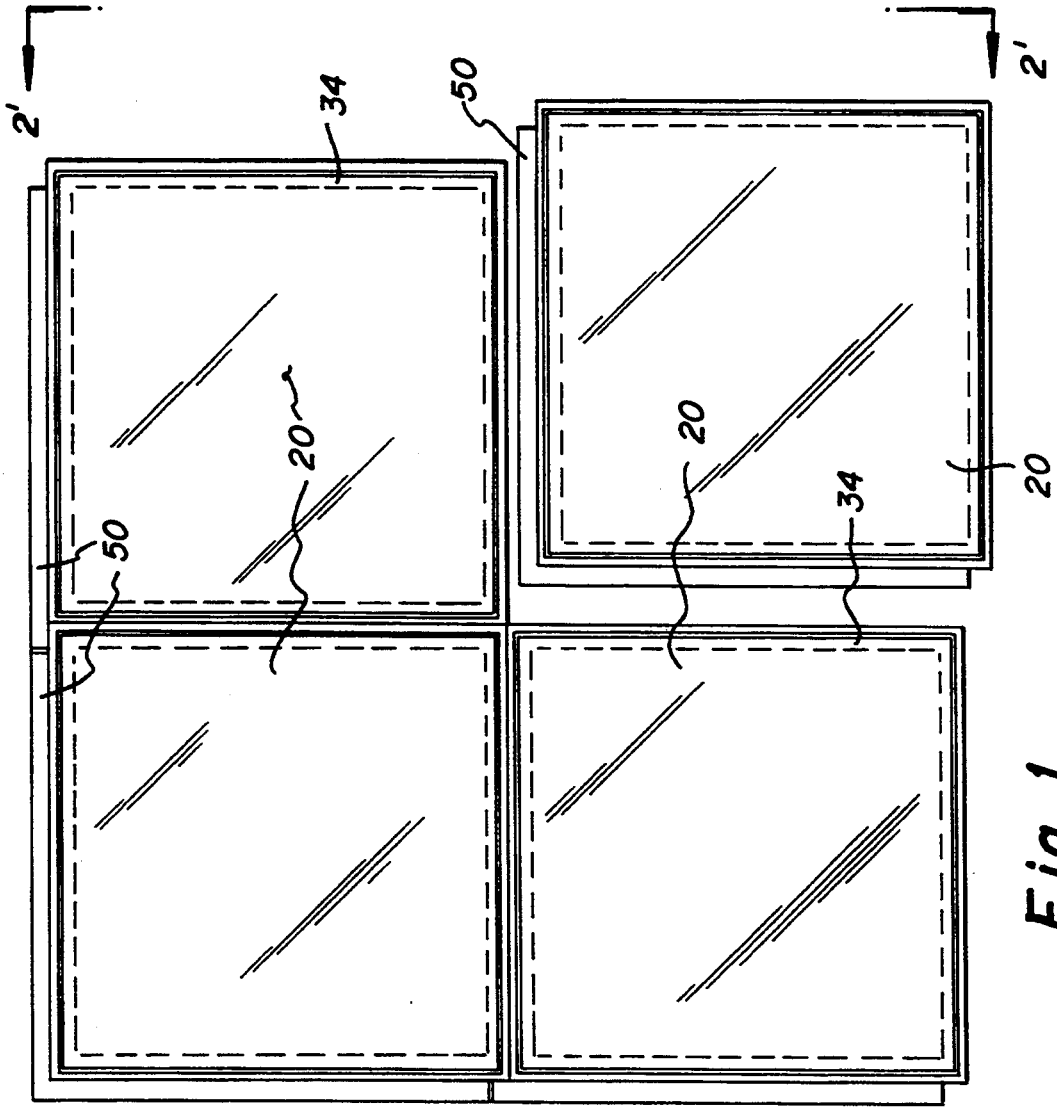
FIG. 1 is an exploded side elevational view of assembled glass blocks of the invention showing one glass block removed.

The preferred embodiment and best mode of the invention is shown in FIGS. 1 through 4. The inventive glass block 20 is produced by joining two members, pieces or panels of cast glass 22 with an aluminum spacer channel member 24 to space the cast glass members 22 apart with a void or airspace 23 therebetween and hold all components in a static position. The pieces of cast glass 22 are typically 1 inch thick and become the frontal surfaces the component glass block 20 which typically is 3 inches thick overall and 8 inches by 8 inches in dimensions. It will be appreciated, however, that the blocks can be produced in a variety of shapes in dimensions up to 12 inches by 12 inches and that the overall thickness of the block can be varied. The glass members 22 are secured to an aluminum channel member 24 by silicone 26 applied in the outside notches 30 and 32 formed by the underside of flanges of the aluminum channel member 24 and the outer side surface 27 of the cast glass member.

Figure 5:
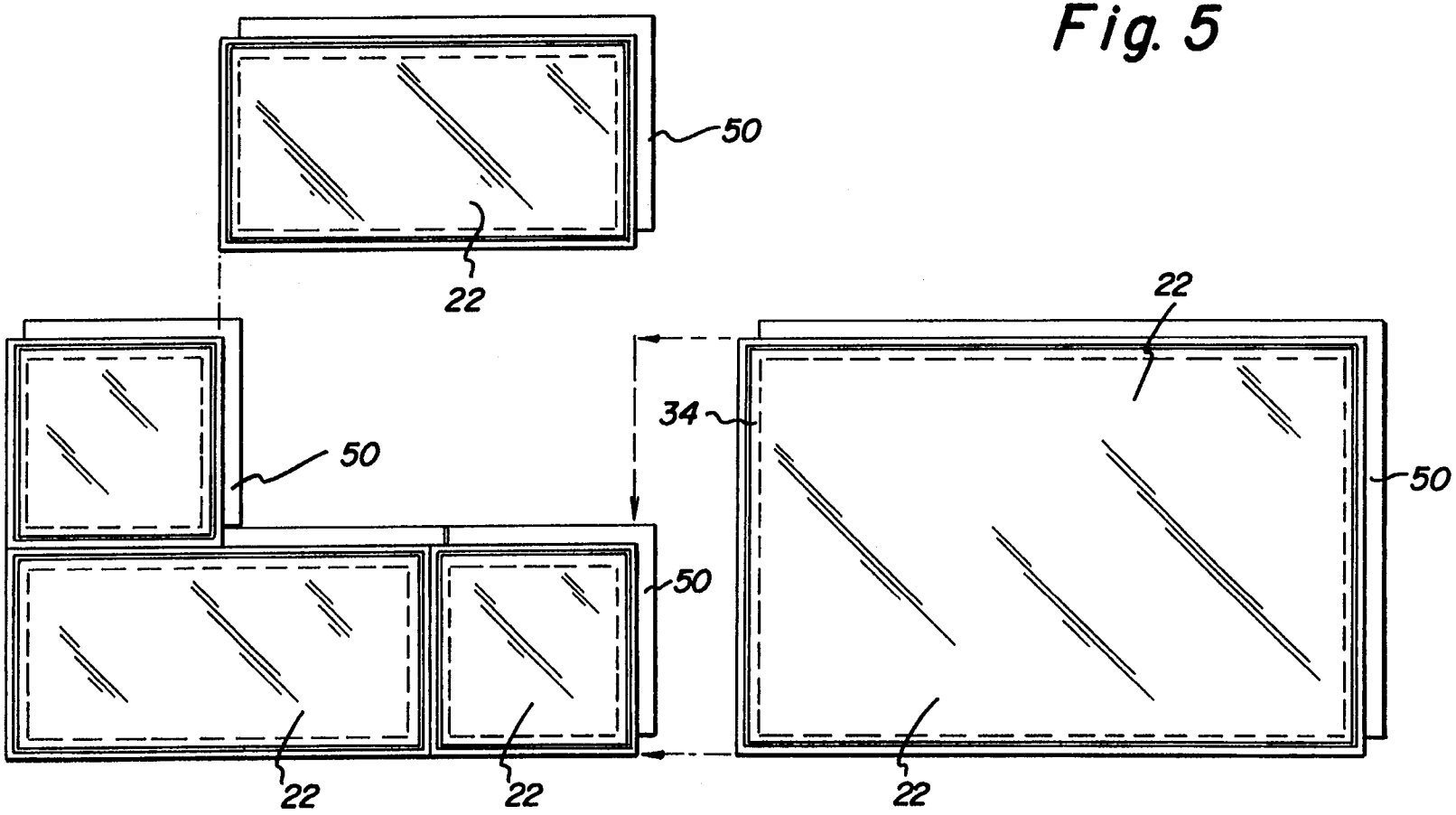
FIG. 5 is a side elevational view partially in phantom showing an assembly of glass blocks of varying sizes for an irregular coursing with one rectangular block removed.

The cast glass pieces 22 are produced by pouring molten glass into open metal molds having the desired dimension of the cast glass. While the mold of the present invention is 8 inches square and 1 inch thick, it will be appreciated that rectangular molds of any desired length, height and width could be used to produced the varied rectangular shapes as seen in FIG. 5 or the hexagonal configuration shown in FIG. 6 or the triangular configuration shown in FIG. 7 . The molten glass assumes the texture of the mold surface on the bottom and four sides and is smooth on the top surface of the mold which is left open. During cooling, any kinds of textures can be applied to the top surface or through the molding process and after cooling, etching can be applied by sandblasting or hydrofluoric acid if desired. If desired, the cast glass can have a mirrored surface. The cast glass can also be colored by adding additional substances during the heating of the glass at approximately 2700° Fahrenheit. These additional substances stop certain wavelengths of light from passing through the glass so that the unabsorbed wavelengths give the glass its color. There are currently two common basic methods of coloring glass. In one method, certain metal oxides are dissolved in the glass during the heating process resulting in the molecular structure of the solution being such that it absorbs wavelengths of certain colors and in the other method, chemical particles may be dispersed or suspended in a liquid and if they are approximately the same size as the wavelengths of light, certain colors will pass through the glass while others are stopped.

The aluminum channel member 24 is an extruded shape of varying thicknesses. This member can be anodized in special colors. The channel member is produced in continuous lengths approximately 20 feet long. The lengths are cut to dimensions equal to the total periphery of the respective cast glass pieces 22. The channel member is then notched in a 90° angle and rotated 45° around the corners of the cast glass pieces 22 which allows the channel member to be bent in the shape of the cast glass. The channel member is provided with outer flanges 28 and defines an inner channel 34 with side walls 38 recessed ¼ inch below the plane of the outer flanges 28. The bottom channel wall 40 is integrally formed on the ends of the side walls 38 and is parallel to the outer flanges 28. The outer flanges 28 are provided with block spacers 42 which together with the thicker body of the flanges 28, transfer the weight of the glass blocks to the faces of the cast glass pieces 22 when they are assembled together. The two perpendicular side walls 38 of the channel abut and capture the cast glass pieces 22 on each side and receive a locking ridge member 50.

Figure 3:
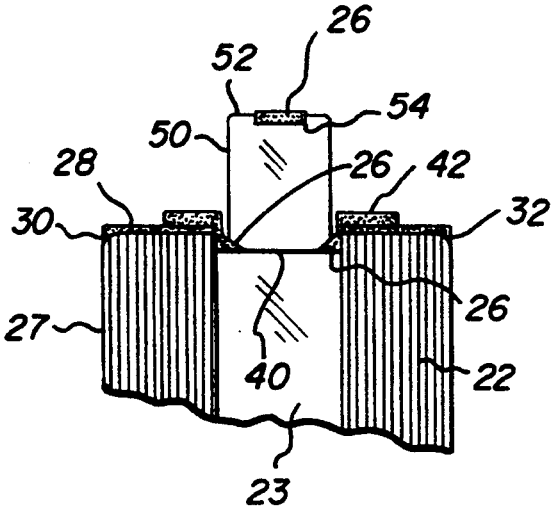
FIG. 3 is an enlarged partial view of end A of the spaced blocks in FIG. 2 showing areas of application of silicone and the locking rib in an exploded relationship.
Figure 4:
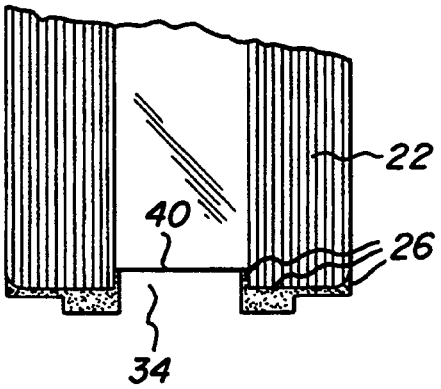
FIG. 4 is an enlarged cross sectional view taken from end B of the blocks of FIG. 2 showing areas of application of silicone.

After the cast glass pieces 22 are fitted and respectively secured to both side walls 38 of the spacer channel member and the flanges 28, another extruded aluminum rib 50 referred to as a locking rib is fit into the recessed channel 34 as shown in FIGS. 2 and 3 and secured in the channel 34 with silicone 26 as shown in FIG. 3. The rib 50 is an inverted block "C" shape in cross section with the stem 52 of the "C" formed with a recess or channel 54 to receive a silicone sealer. Prior to the fitting, the locking rib is cut into a length equal to the inside dimension of two legs of the channel member 24. When the locking rib 50 is fitted into the channel 34, it is approximately ¼ inch shorter than the side lengths of the cast glass as is shown in phantom in FIG. 1. The channel member 24 and the locking rib 50 may also be produced by an injected mold process of ABS (acrylonitrile-butadiene styrene) plastic. These parts have the same shape and profile dimensions and perform the same function as if they were extruded aluminum. The silicone that is used to adhere the channel member 24 to the cast glass blocks 22 and the locking rib 40 is composed of polydimethylsiloxane base 70131-67-8; Trade Secret Registry 11476 01 4-5092; Trade Secret Registry 11473 01 4-5073; methyltriacetoxysilane 4253-34-3. The silicone is cured by exposure to typically over a seven day period for full curing.

The Installation of the Interlocking Glass Blocks

Figure 8:
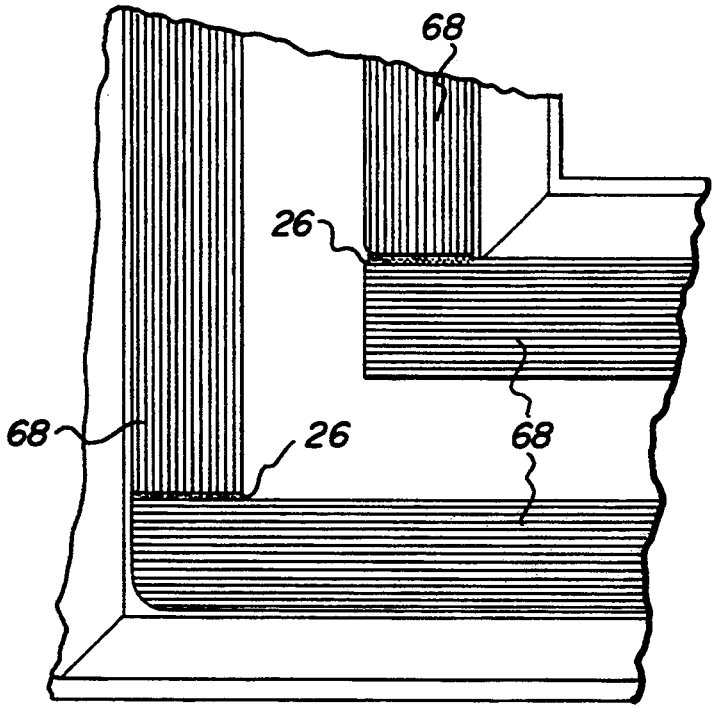
FIG. 8 is a cross sectional view of a corner construction of the invention.
Figure 10:
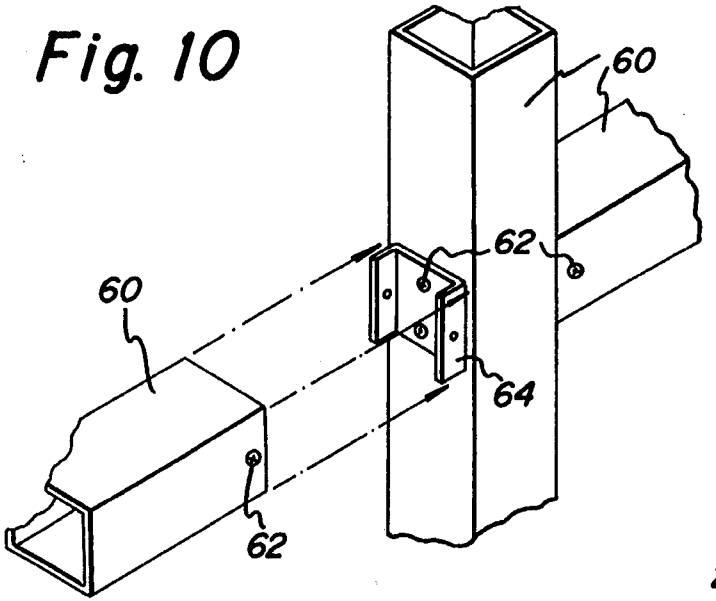
FIG. 10 is perspective view partially in phantom showing connections of reinforcing tubes which may be optionally used to hold the glass block assembly in place.

The glass blocks 20 are assembled together to create a wall, partition, or window by fitting the locking rib 50 of one block into the recessed channel 34 of the other two adjacent blocks. After the blocks are fitted together, a ¼ inch wide reveal is left which can be either left open or filled with a sealant such as silicone. If, however, the block assembly is exposed to weather, the reveal should be sealed. Continuous extruded aluminum structural tubes 60 as seen in FIG. 10 can be integrated into the assembly of the glass block wall to provide a stronger overall wall assembly. These tubes 60 which can be installed horizontally and vertically are fit into an open channel 34 of the channel member 24 in the same manner that the locking ribs 50 of one block are fit into the channels 34 of the other blocks differing only that both adjacent blocks have been open channels to receive the structural tubes. However, these structural tubes 60 should be continuous, though the horizontal and vertical tubes can be joined together with screws 62 and mounting brackets 64. For 90° corners, special blocks 68 would be produced as is shown in FIG. 8. These blocks have one surface extended to the front of the perpendicular face of the return side on both front and back sides and have the same locking channel member and channel with locking rib arrangement.

Figure 9:
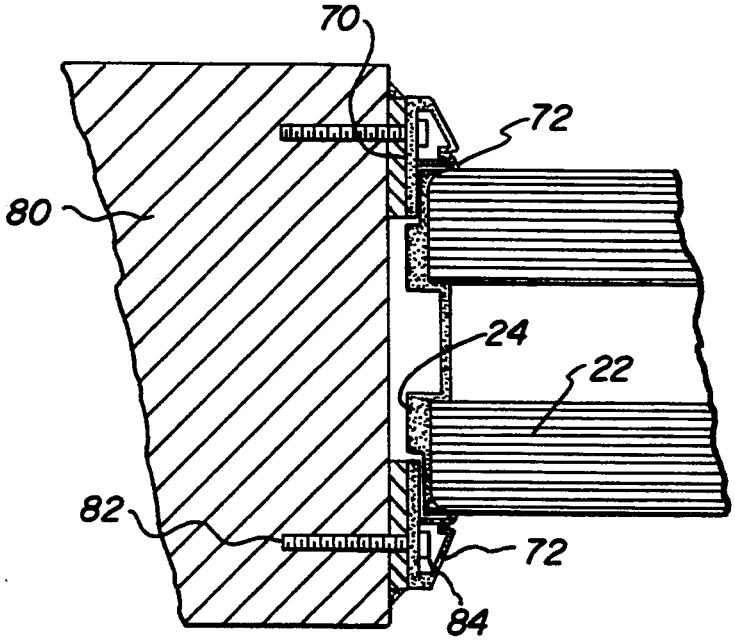
FIG. 9 is a cross sectional view of a perimeter frame secured to a wall which is adapted to receive the inventive block.

The glass block 20 can be installed into a wall opening with the use of a locking perimeter frame 70 as shown in FIG. 9. The frame 70 has an extended portion 72 that fits onto the channel member 24 of the cast glass pieces 22 and is anchored to the wall 80 with screws 82 which are covered with a snap on cover plate 84. In the assembly of the glass block wall window, the sill member and one jam member are installed prior to laying the glass blocks. The glass blocks are installed onto locking perimeter frame and after all the blocks are installed in the opening, the other jam and head locking perimeters are installed by sliding them between the edge of the blocks and return of the wall and fitting the perimeter locking frame 70 into the reveal space of the channel member 24. Shims can be used to block the perimeter locking channel when necessary and anchors are then run through the perimeter locking frame and the shims into the wall. After the perimeter locking frames are installed, snap on cover plates are secured and a sealant such as silicone is run along the perimeter of the glass blocks and the perimeter snap on cover plates as well as the joint at the wall.

Figure 11:
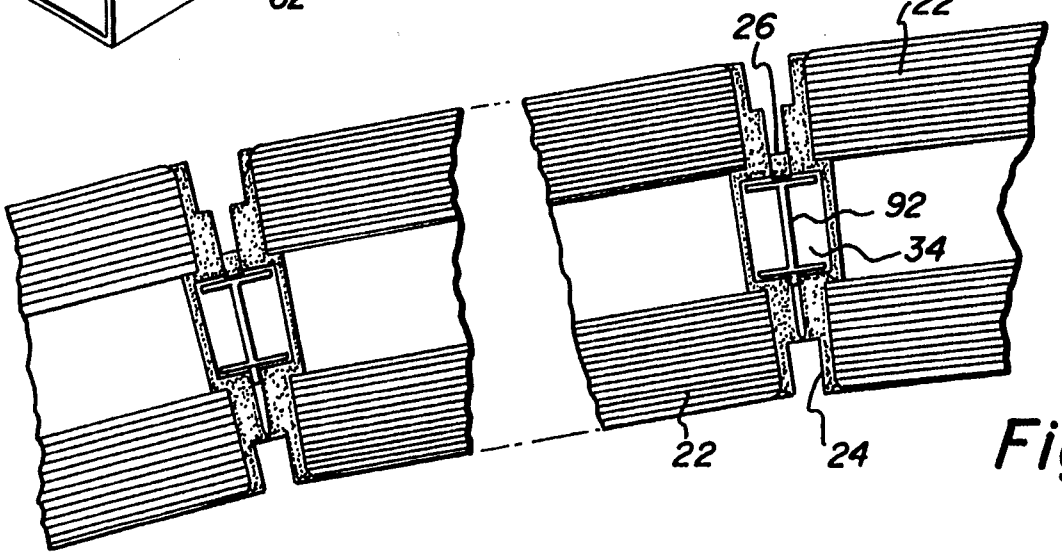
FIG. 11 is a cross sectional view of a curved section of the interlocking glass block assembly.
Figure 13:
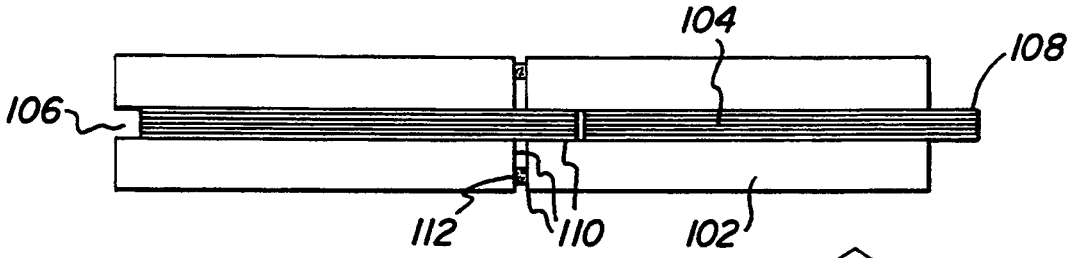
FIG. 13 is an enlarged top plan view of two of the connected glass blocks shown in FIG. 12.
Figure 14:
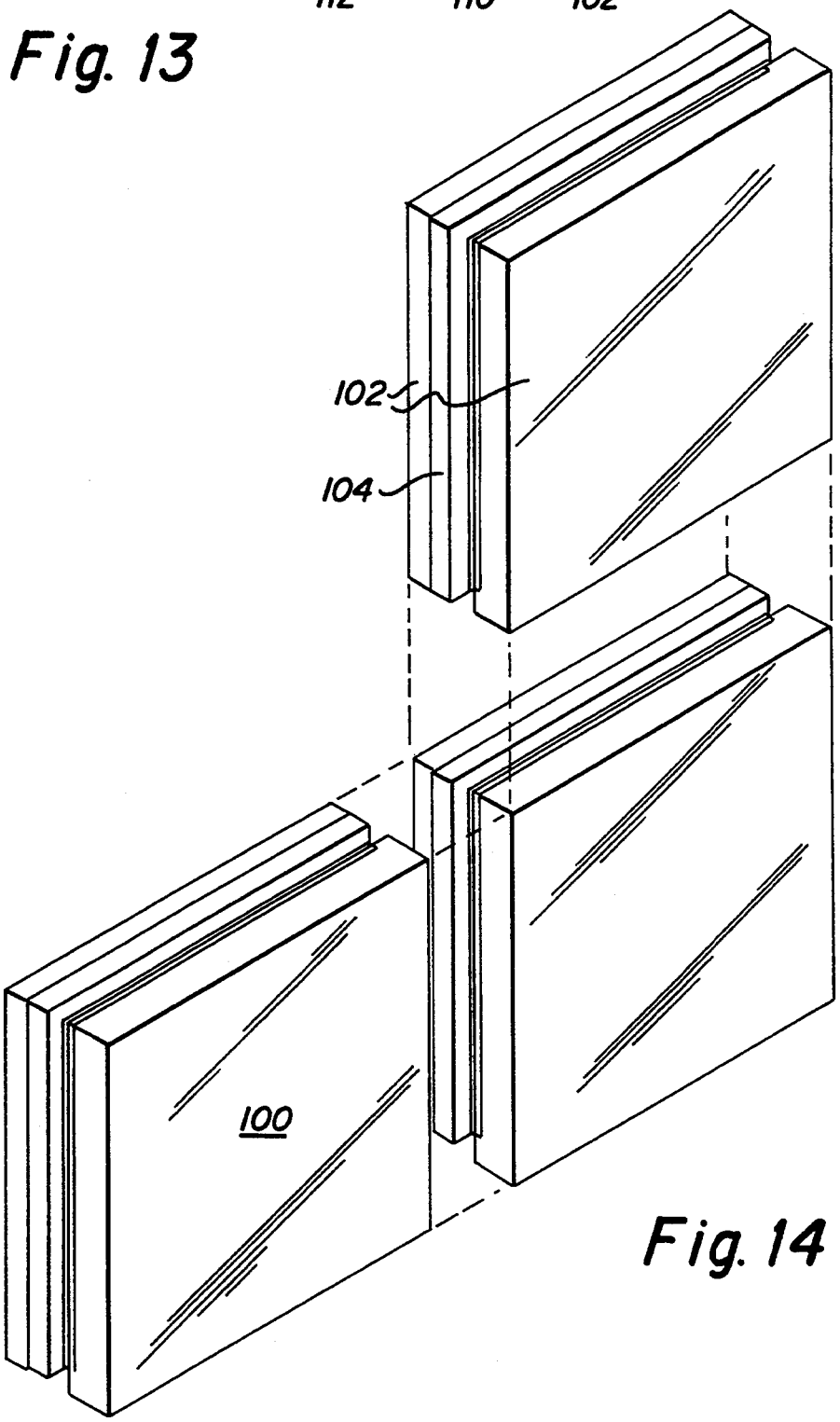
FIG. 14 is an exploded view of the glass blocks shown in FIG. 12.

For curved sections, as shown in FIG. 11, the interlocking glass blocks are produced with a locking rib 50 on only the course side of the glass block 20. In the assembly of the curved sections, the perimeter locking frame and the snap on cover frames are bent to the radius of the curve and anchored to the sill. The blocks are installed onto the perimeter frame and laid up in vertical courses with a continuous vertical aluminum I-rod 92 fit into the spacer channel. After all the blocks are installed in the curved section, silicone 26 is run along the inside and outside joint of the vertical I-rod 92 and the channels 34. Along the head, another rolled length of locking perimeter frame and corresponding cover plate are installed, anchored and sealed.

Figure 6:
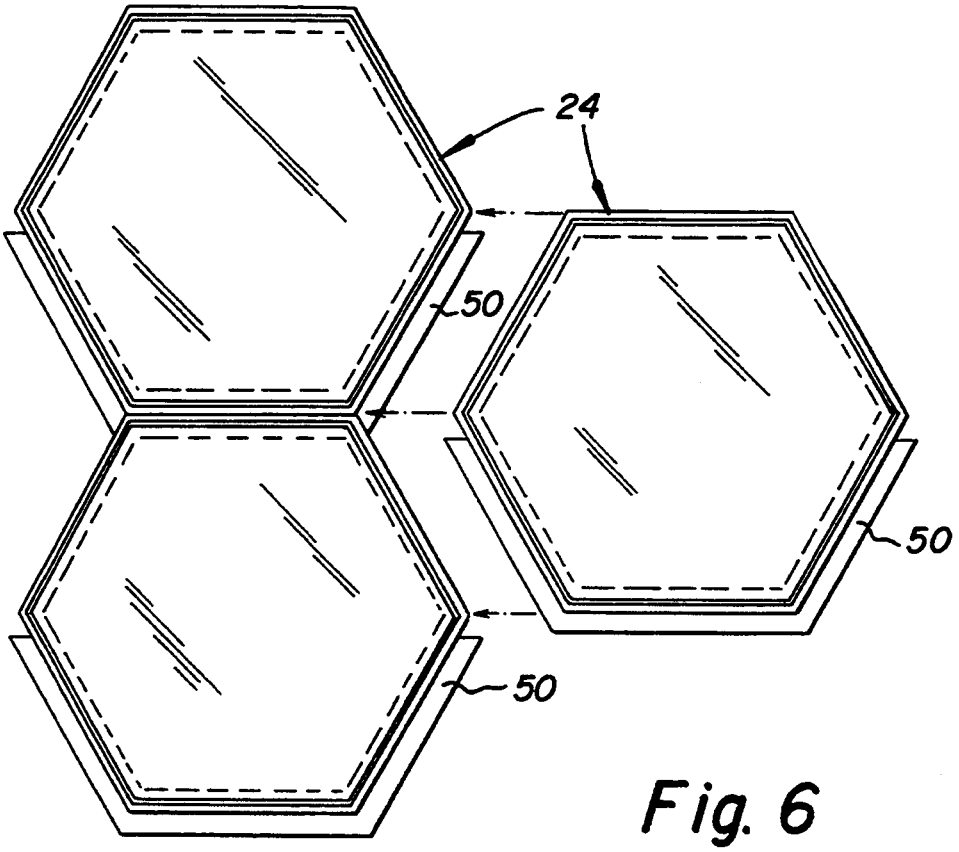
FIG. 6 a side elevational view of an assembly partially in phantom of interlocking hexagonal glass blocks of the invention with one hexagonal block removed.
Figure 7:
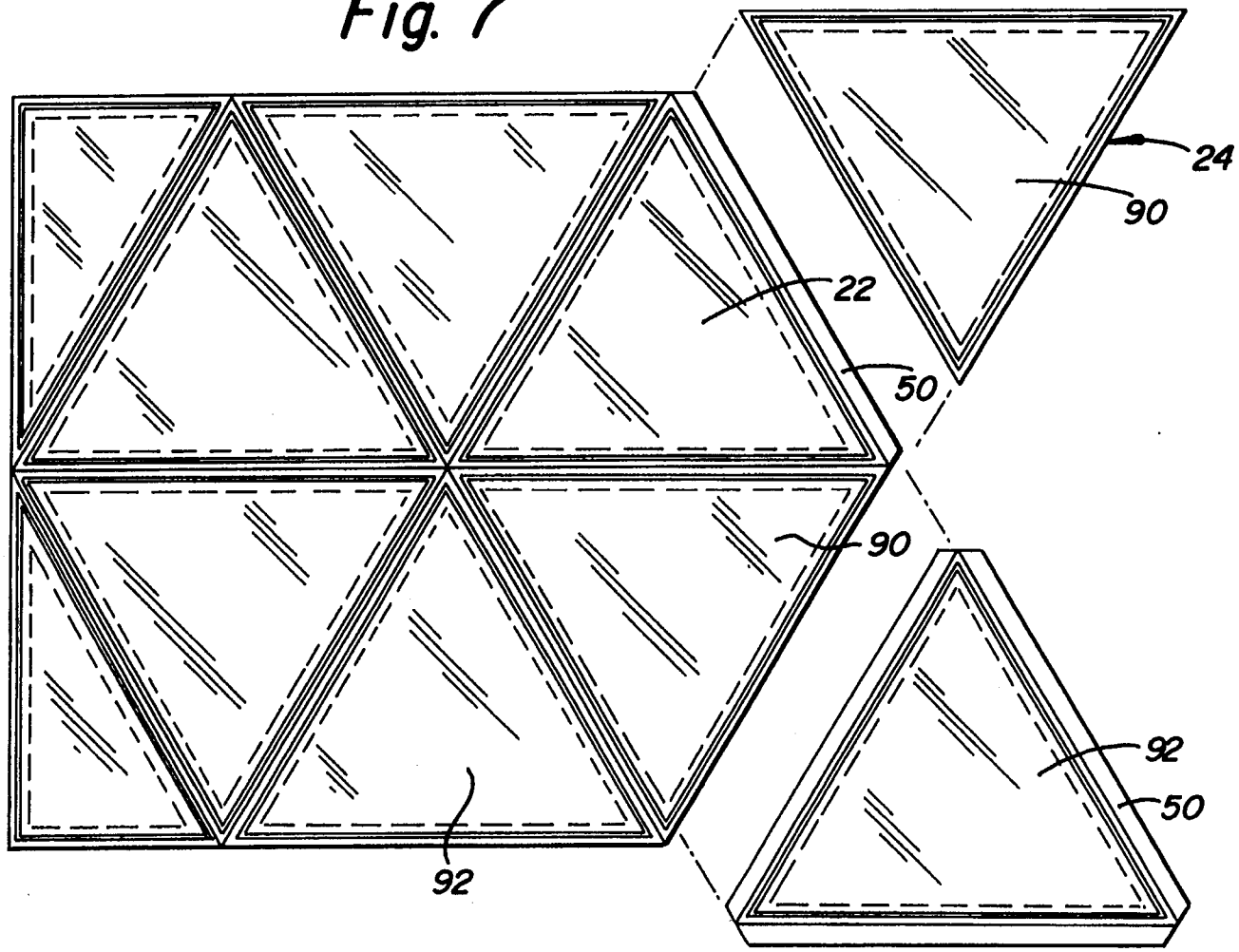
FIG. 7 is a side elevational view partially in phantom of an assembly of interlocking triangular glass block with two triangle blocks removed.

It should be noted that the interlocking glass blocks can be produced in any flat angular faced interlocking geometric shape as hexagons, triangles, and the like as shown by FIGS. 6 and 7. Different shapes require different configuration of locking ribs and channel as is shown in the figures. For triangular blocks, the channel member 24 would be used on all three sides of all the blocks which are referred to as negative blocks 90 but the locking rib 50 would fit into the channel 34 on all three sides of every other block, stopping at the point of each corner. Such blocks are referred to positive blocks 92. The other blocks referred to as negative blocks 90 would only have the channel 34 and would receive the locking ribs of the three adjacent blocks during installation. These blocks are referred to as negative blocks. The hexagonal blocks as shown in FIG. 6 would also have a spacer channel along all six sides, although these blocks would have a locking rib 50 fit on only three sides. They would be installed, again by fitting the protruding locking channel of one block into the open spacer channel of adjacent blocks.

Figure 12:
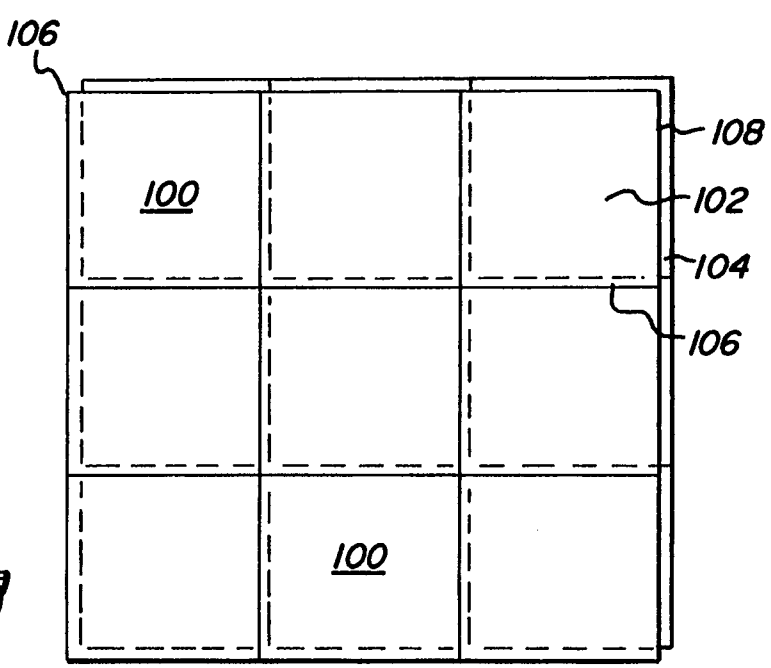
FIG. 12 is a side elevational view partially in phantom of an alternative embodiment of a separate construction of a glass block.

An alternative embodiment of the invention is shown in FIGS. 12 to 15. These glass blocks 100 are composed of three pieces of glass, two of which are hand cast pieces 102 and the other is plate glass 104. The cast glass pieces 102 are secured to both sides of the plate glass 104 which is cut 150 of an inch smaller than the cast glass and is diagonally offset by approximately ¾ of an inch on the two sides from the cast glass as seen in FIG. 12 creating a groove 106 on two adjacent sides of the block and a protrusion 108 on the other two sides. With this configuration, the blocks 100 are installed by fitting the protrusions 108 of the block 100 into the grooves 106 of the adjacent three blocks thereby interlocking the blocks. In the installation, a ¼ inch space 110 is left between blocks which is filled with silicone cement 112.

Although the preferred embodiment discloses a block and a wall formed from hollow glass blocks, it should be understood, it is within the scope of this invention to use blocks made from other materials such as plastic, for example an acrylic plastic and other suitable materials.

In the foregoing description, the invention has been described with reference to a particular preferred embodiment, although it is to be understood that specific details shown are merely illustrative, and the invention may be carried out in other ways without departing from the true spirit and scope of the following claims:

What is claimed is:

1. A glass construction block comprising a plurality of glass members, each glass member comprising a front wall, a rear wall and a plurality of side walls, a frame means surrounding the side walls of said glass members and secured to said glass members spacing said glass members apart from each other, said frame means defining a channel member with side walls and flange portions which extend outward from said channel member side walls over said glass member side walls, said flange portions being secured to said glass member side walls, said frame means including a rib locking member which fits into said channel member, extends outward past said flange portions, and is secured to said channel member, said rib locking member being substantially "C" shaped and defining a channel on one of its sides which can receive and hold adhesive.

2. A glass block as claimed in claim 1 wherein said flange portions are secured to said glass member by silicone.

3. A glass block as claimed in claim 1 wherein said frame member is aluminum.

4. A glass block as claimed in claim 3 wherein said aluminum frame member is anodized in a color.

5. A glass block as claimed in claim 1 wherein said frame member is Acrylonitrile-Butadiene Styrene.

6. A glass block as claimed in claim 1 wherein said glass block has a square configuration.

7. A glass block as claimed in claim 6 wherein said square dimensions range from 6 to 12 inches.

8. A glass block as claimed in claim 1 wherein said glass block has a rectangular configuration.

9. A glass block as claimed in claim 1 wherein said glass block has a hexagonal configuration.

10. A glass block as claimed in claim 1 wherein said glass block has a triangular configuration.

11. A glass block as claimed in claim 1 wherein said frame means includes spacer bars on each flange portion positioned each side of said channel member.

12. A glass block as claimed in claim 1 wherein said flange portions are thicker than side walls of said channel member.

13. A glass block as claimed in claim 1 wherein said glass members are cast glass.

14. A glass construction block comprising a plurality of glass members secured to a single piece frame assembly and spaced apart by said frame assembly to form an air space between said glass members, each glass member comprising a front wall and a back wall and a plurality of side walls, said frame assembly surrounding the side walls of said glass members, said frame assembly defining a channel member with side walls which extend inward into a chamber formed by the back walls of said glass members and a surface of said frame assembly, said side walls terminate in a bottom wall forming the floor of a channel, flange portions extend outward from said channel member side walls to fit over said glass members side walls while not extending past the glass members side walls, said flange portions being secured to said glass members side walls and are constructed of a thicker cross-section than the bottom wall forming the floor of the channel, a protruding rib locking member fits into and is secured in a channel formed in said channel member, said protruding rib locking member projecting outward past the side wall on one half of the sides of said glass members, said flange portions being secured to side wall surfaces of said glass members with securing means.

15. A glass construction block comprising a plurality of angularly configured glass members held in place and spaced apart by a frame assembly, each angularly configured glass member comprising a front wall and a back wall and a plurality of side walls, said frame assembly surrounding the side walls of said glass members and is secured to the side walls of said glass members, said frame assembly defining a channel which runs along its length, said channel being formed by side walls which extend inward toward the center axis of said glass members and a bottom wall connected to said channel member side walls, said frame assembly defining flange portions which are secured to said glass members side walls and extend outward from said channel over said glass members side walls a distance not greater than the width of said glass members said walls, spacer block means secured to said flange portions, said spacer block means transferring the weight of glass blocks to the side wall surface of the glass member when the blocks are assembled together, open linear protruding rib members secured in said channel on at least two of said glass member side walls and extending therefrom for seating engagement with channels on adjacent glass construction blocks.

16. A glass construction block as claimed in claim 15 wherein said channel and said protruding rib members have a rectangular cross section and said flange portions have spacer blocks secured to their outer surface.

17. A glass block wall comprising;

a. a plurality of glass blocks, each of said glass blocks comprising angularly configured glass members held in place and spaced apart by a frame assembly, each angularly configured glass member comprising a front wall and a back wall and a plurality of side walls, said frame assembly surrounding the side walls of said glass members and secured to the side walls of said glass members, said frame assembly defining a channel which runs along its length, said channel being formed by side walls which extend inward toward the center axis of said glass members and a bottom wall connected to said channel member side walls, said frame assembly further defining flange portions which are secured to said glass members side walls and extend outward from said channel over said glass members side walls, a protruding rib member is secured in said channel on at least one of said glass member side walls, said protruding rib member comprising a base member defining a channel and leg flange portions extending away from said base member, b. said glass blocks being laid in a plurality of courses with locking ribs of two adjacent sides of one block being inserted into the channels of the channel member on two adjacent sides of the adjacent block to interlock the same together on two adjacent sides with spaces therebetween, and c. said spaces between said interconnected blocks being sealed with securing means.

18. A glass block wall as claimed in claim 17 wherein said securing means is silicone.

19. A glass block wall as claimed in claim wherein said rib member is an inverted block "C" shape cross section and is cut to a length which is slightly shorter then the side length of the glass members.

20. A glass block wall as claimed in claim 19 wherein said rib member inverted block "C" shape cross section has the stem of the "C" formed with a channel.

21. A glass block wall as claimed in claim 19 wherein said rib member is cut to a length which is about ¼ inch shorter than the side lengths of the glass members.

22. A glass block wall as claimed in claim 17 wherein said plurality of glass blocks are of different sizes.

23. A glass block wall as claimed in claim 17 wherein said plurality of glass blocks are laid in courses which are offset.

* * * * *